US007185772B2

(12) United States Patent
Remmers

(10) Patent No.: US 7,185,772 B2
(45) Date of Patent: Mar. 6, 2007

(54) WIRE SHELF HAVING INTEGRATED HOOKS WITH HANGER ROD

(75) Inventor: Lee E Remmers, Ocala, FL (US)

(73) Assignee: Clairson, Inc., Newark, DE (US)

( * ) Notice: Subject to any disclaimer, the term of this patent is extended or adjusted under 35 U.S.C. 154(b) by 206 days.

(21) Appl. No.: 11/004,788

(22) Filed: Dec. 3, 2004

(65) Prior Publication Data

US 2005/0077261 A1 Apr. 14, 2005

Related U.S. Application Data

(63) Continuation-in-part of application No. 10/235,315, filed on Sep. 5, 2002, now Pat. No. 7,004,335.

(51) Int. Cl.
*A47F 5/08* (2006.01)

(52) U.S. Cl. ..... 211/153; 211/90.03

(58) Field of Classification Search ..... 211/90.03, 211/105.1, 90.02, 181.1, 134, 87.01, 153; D6/511, 566, 553, 567, 574; 108/28, 29; 248/235, 309.1

See application file for complete search history.

(56) References Cited

U.S. PATENT DOCUMENTS

| | | | |
|---|---|---|---|
| 505,360 | A | 9/1893 | Hilliard |
| 1,391,495 | A | 9/1921 | Parsons |
| 1,576,784 | A | 3/1926 | Planett |
| 2,271,784 | A | 2/1942 | Tritt |
| 2,612,273 | A | 9/1952 | Smith |
| 2,788,885 | A | 4/1957 | Begent |
| 2,859,879 | A | 11/1958 | Rogers et al. |
| 2,870,916 | A | 1/1959 | Bonia et al. |
| 3,141,556 | A | 7/1964 | Kolsterman |
| 3,225,940 | A | 12/1965 | Story |
| 3,598,064 | A | 8/1971 | Stempel |
| 3,688,915 | A | 9/1972 | Ramsey |
| 3,972,499 | A | 8/1976 | Simmons |
| 4,316,593 | A | 2/1982 | Miner et al. |
| 4,493,423 | A | 1/1985 | Kaeslin et al. |
| 4,671,419 | A | 6/1987 | Beverly |
| 4,717,104 | A | 1/1988 | Lee |
| 4,762,238 | A | 8/1988 | Blanchard |
| 5,050,750 | A | 9/1991 | Mason |
| D349,000 | S | 7/1994 | Rogers et al. |
| 5,350,072 | A | 9/1994 | Rogers et al. |

(Continued)

FOREIGN PATENT DOCUMENTS

| | | |
|---|---|---|
| DE | 2007991 | 9/1971 |

(Continued)

OTHER PUBLICATIONS

U.S. Appl. No. 60/434,470, filed Dec. 18, 2002, Costa et al.

*Primary Examiner*—Jennifer E. Novosad
(74) *Attorney, Agent, or Firm*—Harness, Dickey & Pierce, P.L.C.

(57) ABSTRACT

A shelf includes a plurality of integrated hook members supporting a rod member to provide free movement of items supported by the rod member. The hook members are integrally connected to support members of the shelf deck to support the rod member for use in, for example, hanging items thereon.

22 Claims, 10 Drawing Sheets

U.S. PATENT DOCUMENTS

| | | | |
|---|---|---|---|
| 5,351,842 | A | 10/1994 | Remmers |
| D352,195 | S | 11/1994 | Rogers et al. |
| 5,373,951 | A | 12/1994 | Arnold |
| D354,864 | S | 1/1995 | Kokenge et al. |
| 5,405,026 | A | 4/1995 | Lee et al. |
| 5,531,416 | A | 7/1996 | Remmers |
| 5,647,490 | A | 7/1997 | Hull et al. |
| 5,758,851 | A | 6/1998 | Remmers |
| 5,810,179 | A | 9/1998 | Kleiman |
| 5,836,461 | A | 11/1998 | Kokenge et al. |
| D419,344 | S | 1/2000 | Grenne |
| D427,466 | S | 7/2000 | Remmers |
| D437,515 | S | 2/2001 | Remmers et al. |
| D527,559 | S * | 9/2006 | Remmers ..... D6/511 |
| 2005/0011420 | A1 | 1/2005 | Costa et al. |
| 2005/0145147 | A1 | 7/2005 | Costa et al. |
| 2005/0145588 | A1 | 7/2005 | Stitchick et al. |
| 2005/0150436 | A1 | 7/2005 | Marchetta et al. |

FOREIGN PATENT DOCUMENTS

| | | |
|---|---|---|
| FR | 1251070 | 12/1960 |
| FR | 2562777 | 10/1985 |
| SE | 164969 | 9/1957 |

* cited by examiner

WIRE SHELF HAVING INTEGRATED HOOKS WITH HANGER ROD

CROSS-REFERENCE TO RELATED APPLICATION

This application is a continuation-in-part of application Ser. No. 10/235,315, filed Sep. 5, 2002 now U.S. Pat. No. 7,004,335, the entire disclosure of which is incorporated herein by reference.

FIELD OF THE INVENTION

The present invention relates generally to wire shelf storage systems, and more particularly to a wire shelf having a hanger rod integrally connected thereto.

BACKGROUND OF THE INVENTION

Efficient and organized use of building space is very desirable, particularly with respect to storage or utility space in businesses, residential homes and apartments. In particular, because of the limited or tight spaces in these locations, maximizing the amount of useable space is very important. Likewise, providing ease in access and increased user convenience is important.

With respect to closet organization and the design of closet storage units, particularly for residential use, many different options are available including, for example, different sizes and shapes of shelves, different attachment and mounting members and different storage members (e.g., wire baskets, shoe-stands and tie/belt racks). Ease in accessing stored items, such as clothing, is important. Further, ease in moving stored items to make room for other items or to access items not readily accessible, is likewise important.

It is common today to use ventilated shelving (e.g., wire or plastic, and associated components) to construct storage units within closets. Typical ventilated shelving not only varies in size (e.g., different lengths and widths), and configuration (e.g., different wire mesh spacing), but may have connected thereto different storage or attachment members, including for example, a hanging shoe storage device or clothes on hangers. It is desirable for a single unit to include any such attachment or storage devices preassembled and connected thereto. In particular, and for example, having a single unit reduces installation time.

Shelving units with integrally connected storage or attachment devices are known. For example, different configurations for providing hanger rod attachments connected to wire shelving are known. However, these designs are often not user friendly, such as having the hanger rod located behind the front of the wire shelf, or attached in such a manner that makes construction difficult and/or is more likely to result in failure (e.g., attachment of hanger rod assembly to a single support member). Thus, although these shelves with integrated hanger rods provide for easier movement of items along a shelf, for example, sliding clothes on hangers, they are often difficult to access or are susceptible to failure, for example, when hanging heavier, bulky items thereon.

SUMMARY OF THE INVENTION

A shelf of the present invention provides a rod member integrally connected thereto using a plurality of hooks. Generally, the shelf includes a plurality of hook members together provided as a one-piece welded assembly to the shelf deck with a horizontally extending rod member attached to an end of each of the hook members to provide continuous free slide of items along the rod member.

In one embodiment, a wire shelf includes a plurality of wire stringers and support members forming a shelf deck, and a plurality of hook members configured for horizontal connection to the shelf deck and having a rod member connected thereto. The hook members may include a horizontal portion configured for connection to at least two support members (e.g., a front and an intermediate support member). Further, the hook members may include a plurality of curved portions.

In another embodiment a wire shelf with integral rod includes a plurality of longitudinally extending support wires, and a plurality of transversely extending wire stringers forming a shelf deck, a longitudinally extending rod, and a plurality of hooks secured to at least two of the longitudinally extending support wires, and supporting the rod. The plurality of hooks may include a concavely curved portion and a support surface to which the rod is secured, with the concavely curved portion configured to allow hangers on the rod to slide past the plurality of hooks without interference.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. Although a shelf of the present invention may be described in connection with component parts having a particular size and shape, it is not so limited, and the size and shape of the various component parts may be modified as needed or desired.

Figure 1:
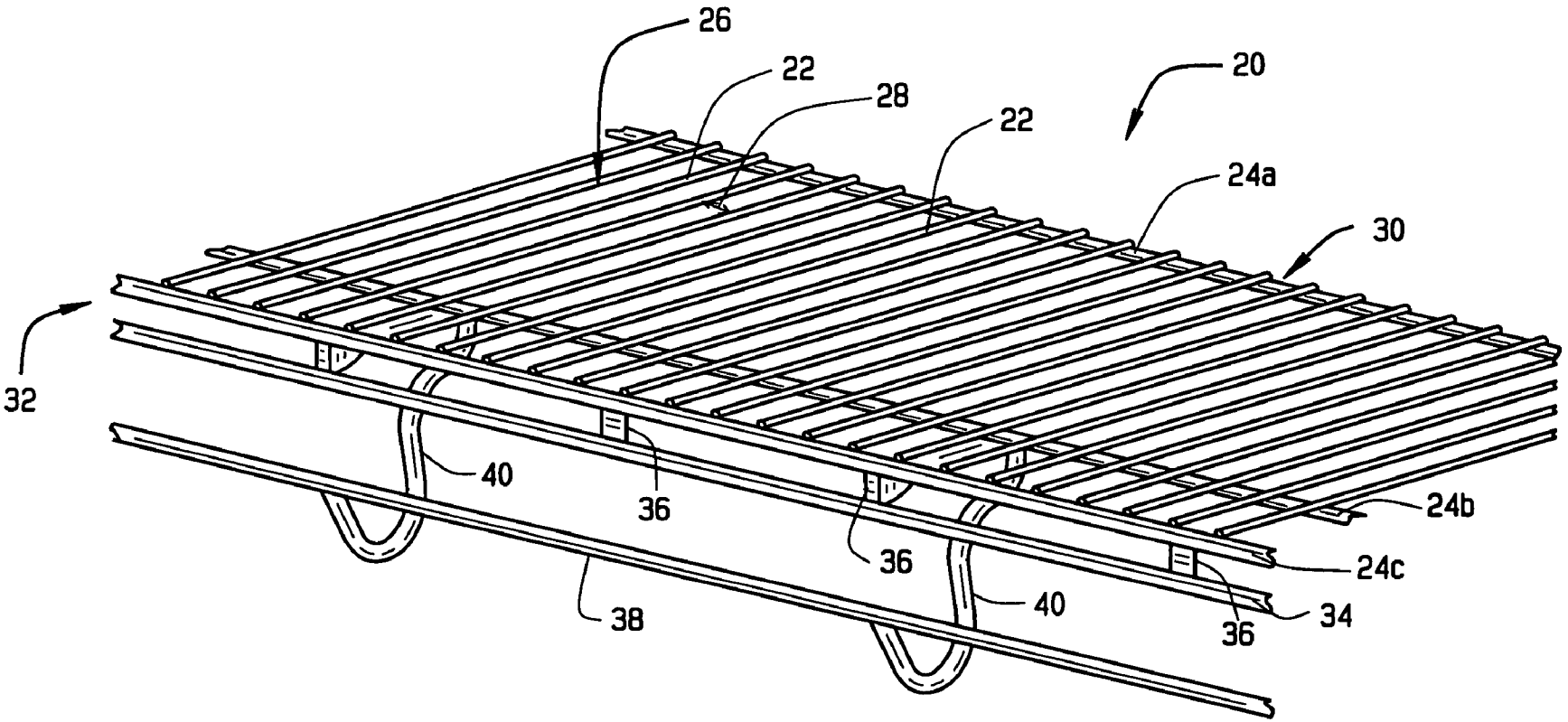
FIG. 1 is a top perspective view of a shelf having an integrated rod member connected thereto according to one exemplary embodiment of the invention.
Figure 2:
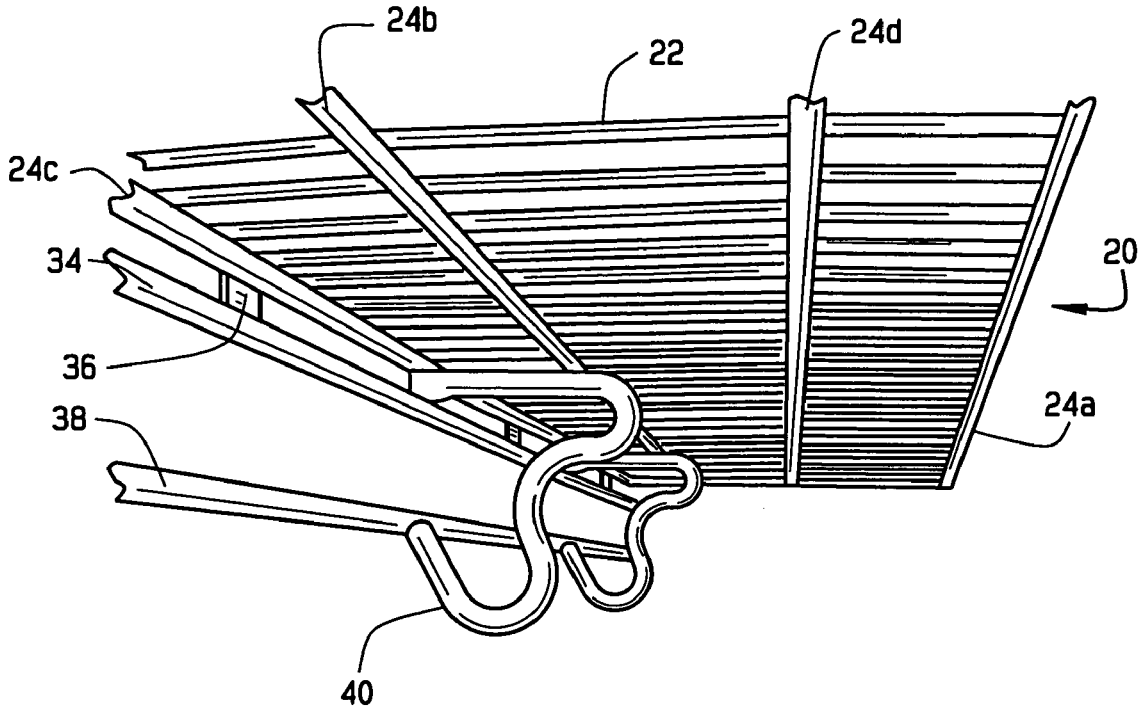
FIG. 2 is a bottom perspective view of the shown in FIG. 1.
Figure 3:
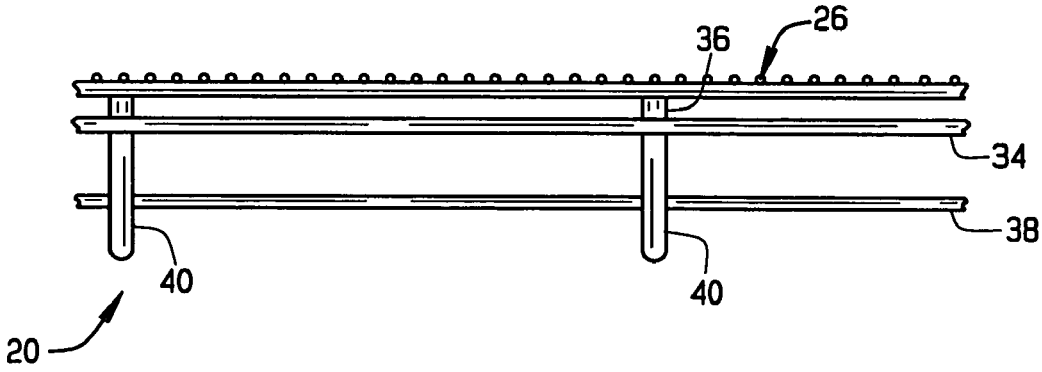
FIG. 3 is a front elevation view of the shelf shown in FIG. 1.

A shelf (e.g., wire shelf unit) having a rod member connected thereto with integrated hooks is shown generally in FIGS. 1 through 3 and identified by reference numeral 20. The shelf 20 generally includes a plurality of transversely extending wire members 22 (i.e., wire stringers) supported by a plurality of longitudinally extending support members 24 to form a shelf deck 26. The transversely extending wire members 22 are typically spaced to provide a ventilated shelf deck 26 construction while preventing items from occupying the spaces 28 between the transversely extending wire members 22.

In a preferred embodiment of the present invention, a plurality of longitudinally extending support members 24 are provided with one longitudinally extending support member 24*a* at a back or rearward end 30 (e.g., closest to a wall on which the shelf 20 is mounted), one longitudinally extending support member 24*c* at the front end 32 of the shelf 20, and one longitudinally extending support member 24*b* that is intermediate longitudinally extending support members 24*a* and 24*c*, and adjacent the front end 32. The front-most longitudinally extending support member 24*c* is connected to a lower longitudinally extending support member 34 with a plurality of vertically extending support members 36. A rod member 38 is connected to the shelf deck 26 (i.e., connected to the longitudinally extending support members 24*b* and 24*c*, and the vertically extending support members 36) using a plurality of integrated hooks 40 as described in more detail herein.

Figure 4:
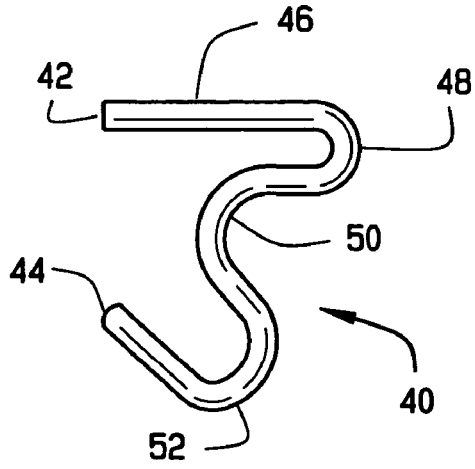
FIG. 4 is a side elevation view of an exemplary hook member shown in FIG. 1.
Figure 6:
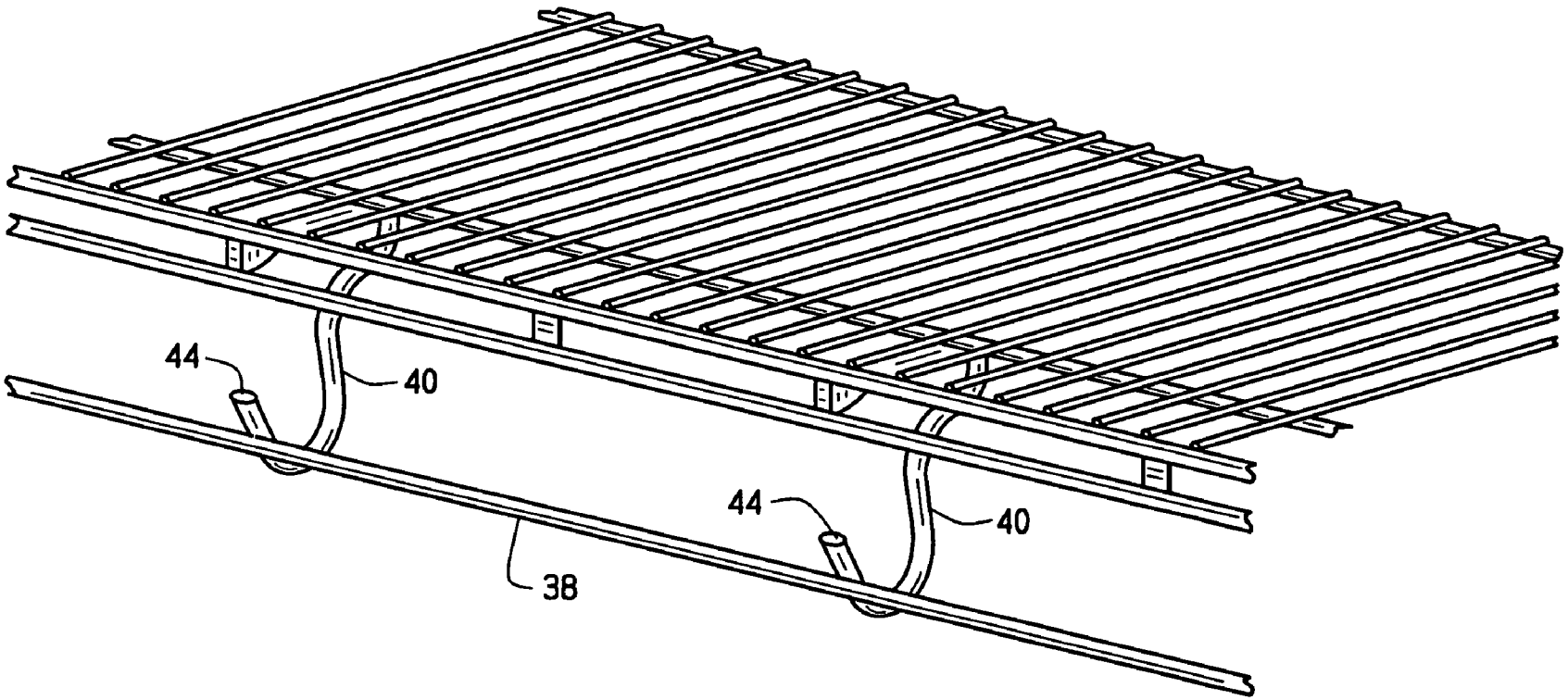
FIG. 6 is a top perspective view of a shelf having an integrated rod member connected thereto according to one exemplary embodiment of the invention.
Figure 7:
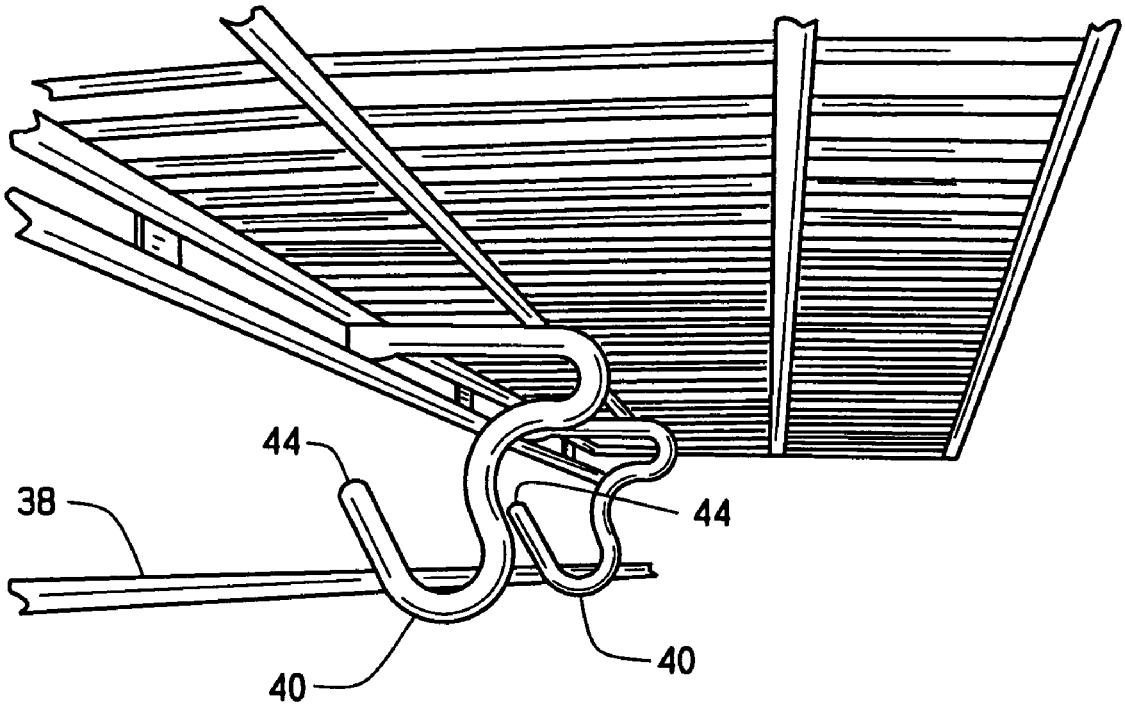
FIG. 7 is a bottom perspective view of the shelf shown in FIG. 6.

In particular, and with respect to the hook member 40 as shown in FIG. 4, it is preferably constructed as a one piece member having a first end 42 and a second end 44. The first end 42 is preferably connected to support members 36, such as for example by welding, and the second end 44 is preferably connected to the rod member 38, such as, for example by welding. It should be noted that the second end 44 may extend past the support rod 38, with the support rod 38 secured at another point on the hook member 40, as shown in FIGS. 6 and 7. Further, the hook member 40 has a generally horizontal upper portion 46 positioned below the two front-most longitudinally extending support members 24*b* and 24*c*, and connected there at its front and back ends, respectively, by welding.

In another preferred construction, the hook member 40 extends from the horizontal upper portion 46 to the second end 44 and configured having a first curved portion 48, a second curved portion 50 and a third curved portion 52. Specifically, the first and third curved portions 48 and 52 are generally configured in concave shape relative to the front end 32 of the shelf 20 and the second curved portion 50 is generally configured in a convex shape relative to the front end 32 of the shelf 20. In this embodiment, the first and second curved portions 48 and 50 are configured at about a forty five degree angle relative to the shelf deck 26, and the third curved portion 52 is configured about perpendicular to the first and second curved portions 48 and 50. The hook member is generally planar, and the first end 42 and second end 44 are generally configured in the same vertical plane such that the rod member 38 is positioned generally below the lower longitudinally extending support member 34.

It should be noted that one or more additional longitudinally extending support members 24*d* may be provided, such as shown in FIG. 2 between the support members 24*a* and 24*b*. Further, the spacing of the hook members 40 and the number of hook members 40 provided may be modified based upon the particular shelf.

Figure 5:
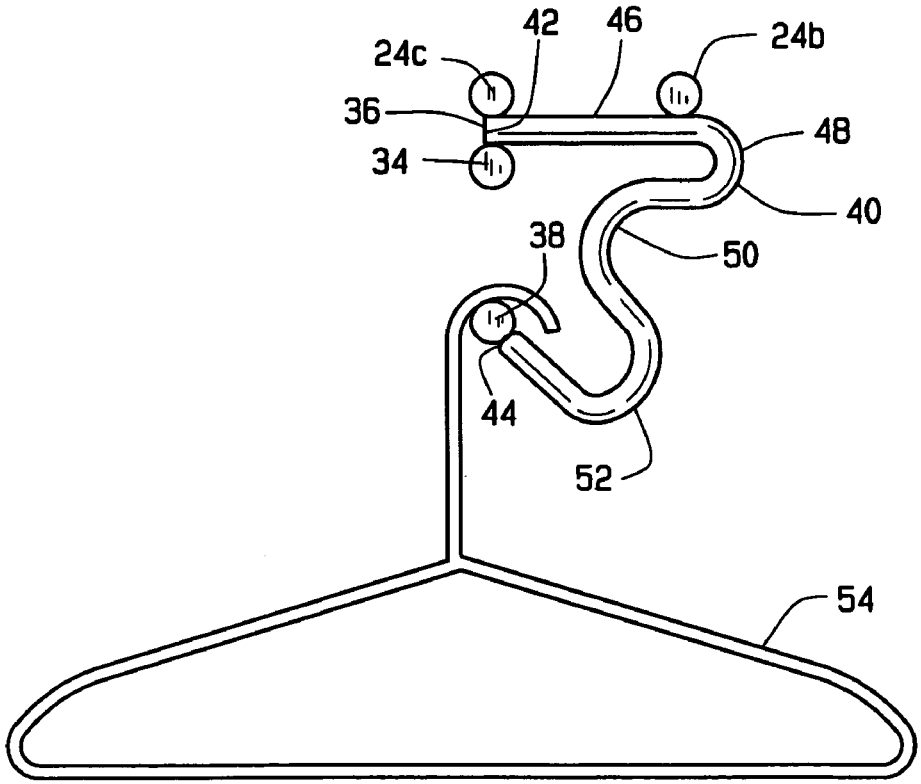
FIG. 5 is a side cross-sectional view of the shelf shown in FIG. 1 having a hanger supported thereon.

In operation, the shelf 20 provides a rod member 38 integrally connected to the shelf deck 26 (i.e., two longitudinally extending support members 24*b* and 24*c* and the vertically extending support members 36) with the plurality of hook members 40 such that items, for example clothing on hangers 54, may easily be placed and moved along the rod member 38. In particular, the third curved portion 52 is configured to accommodate items, such as hangers 54, sliding along the rod member 38 as shown in FIG. 5. Further, the connection of the hook member 40 to the two longitudinally extending support members 24*b* and 24*c* and the vertically extending support members 36 provides easier manufacture of the shelf 20 (i.e., assembly of the shelf 20 to hook members 40 and rod member 38 in a single operation) and reduces the likelihood of failure, for example, when hanging many bulky items on the rod member 38.

Figure 8:
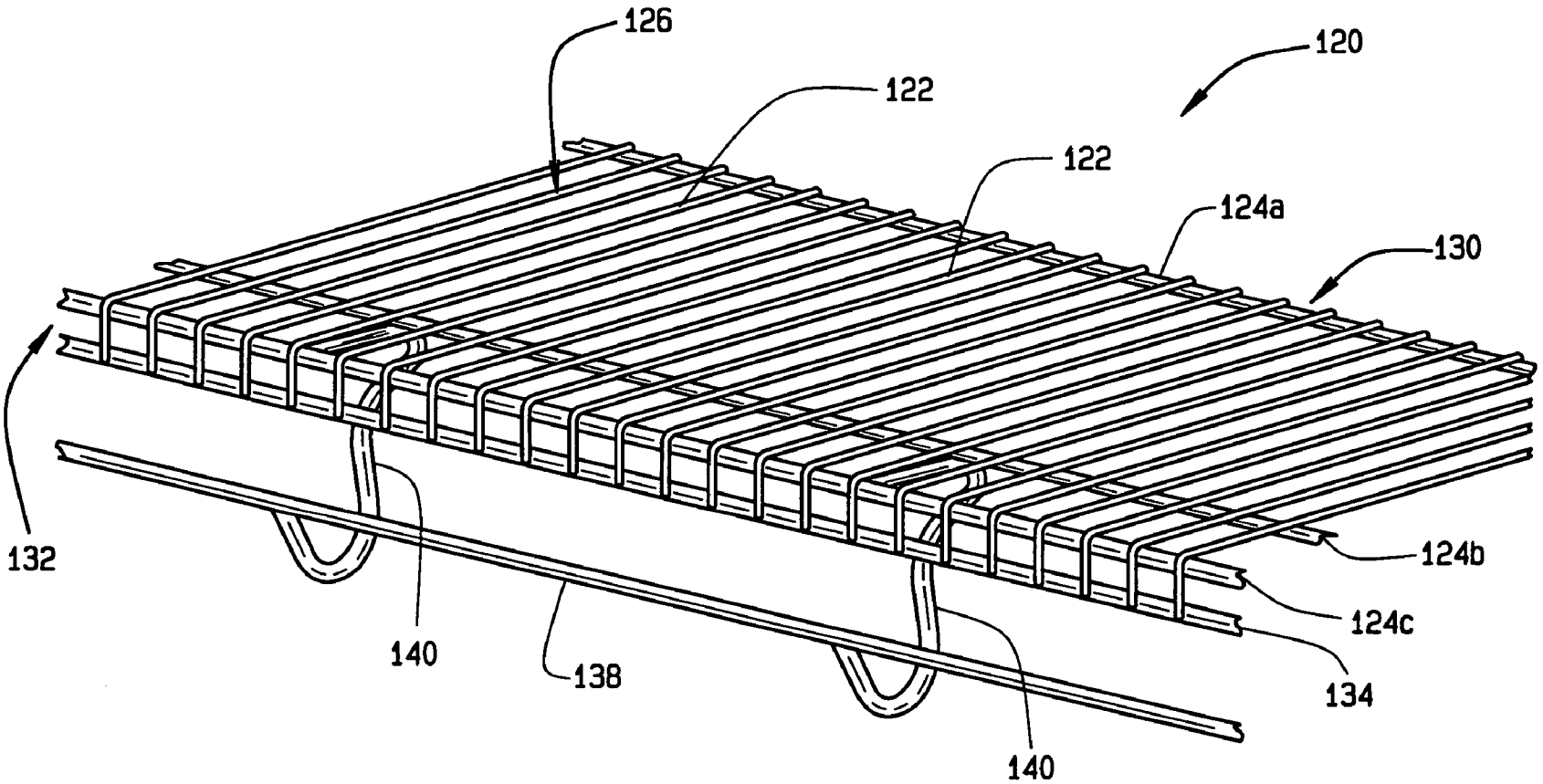
FIG. 8 is a top perspective view of a shelf having an integrated rod member connected thereto according to one exemplary embodiment of the invention.

FIG. 8 illustrates another embodiment of a shelf 120 including means (e.g., hook members 140, etc.) for supporting a rod member 138. As shown, the shelf 120 generally includes a plurality of transversely extending wire members 122 supported by a plurality of longitudinally extending support members 124 to form a shelf deck 126. In this particular illustrated embodiment, the longitudinally extending support members 124 include a back support member 124*a*, an intermediate support member 124*b*, and a front support member 124*c*. The intermediate support member 124*b* is between the front and back support members 124*c* and 124*a*.

Figure 9:
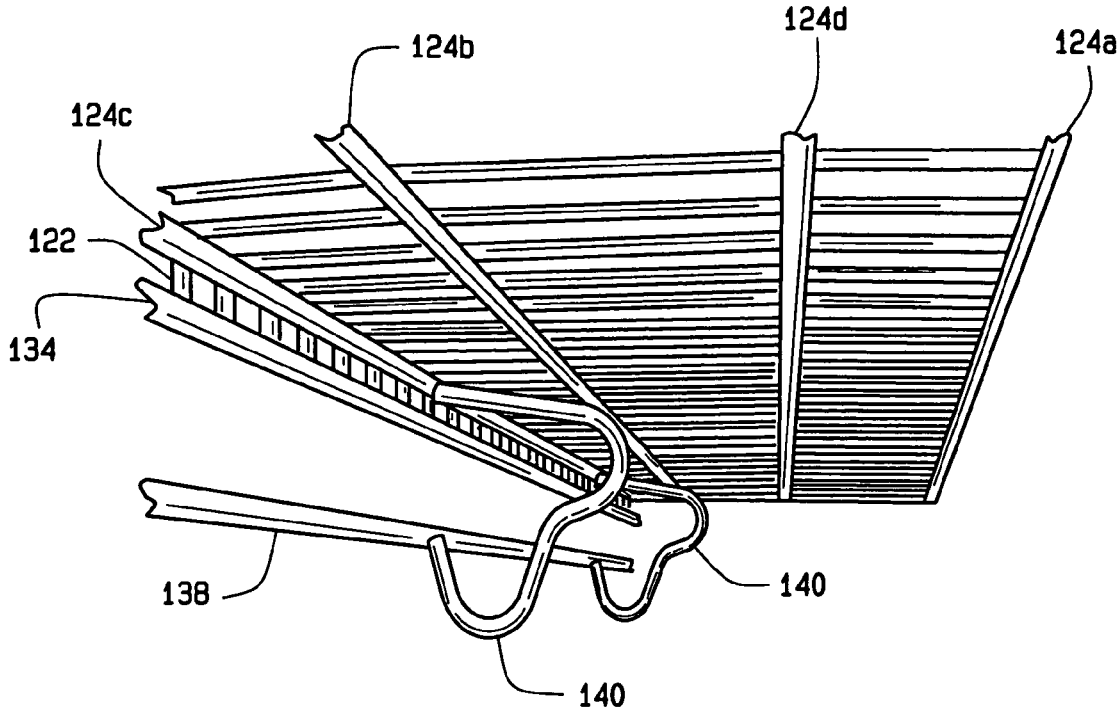
FIG. 9 is a bottom perspective view of the shelf shown in FIG. 8 including an additional longitudinally extending support member according to another exemplary embodiment of the invention.
Figure 10:
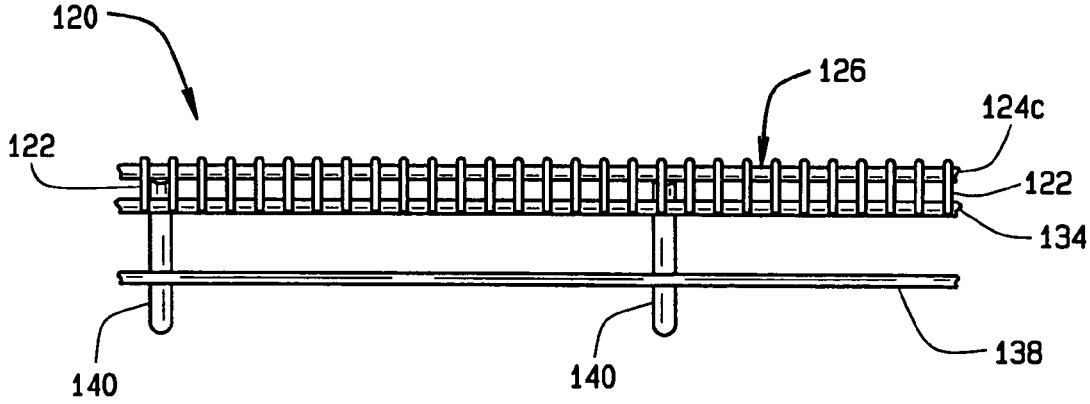
FIG. 10 is a front elevation view of the shelf shown in FIG. 8.

Alternatively, other configurations and arrangements for the wire members 122 and support member 124 are possible as aspects of the invention are not limited to any particular number, shape, size, and arrangement of wire members and support members. For example, one or more additional longitudinally extending support members 124*d* may be provided, such as shown in FIG. 9 between the support members 124*a* and 124*b*. Further, the spacing of the hook members 140 and the number of hook members 140 provided may be modified based upon the particular shelf.

With further reference to FIG. 8, the wire members 122 extend from a back or rearward end 130 (e.g., closest to a wall on which the shelf 120 is mounted) to the shelf's front end 132. In this particular embodiment, the wire members 122 extend over the front support member 124*c* and cascade downwardly to connect to a lower support member 134.

Figure 11:
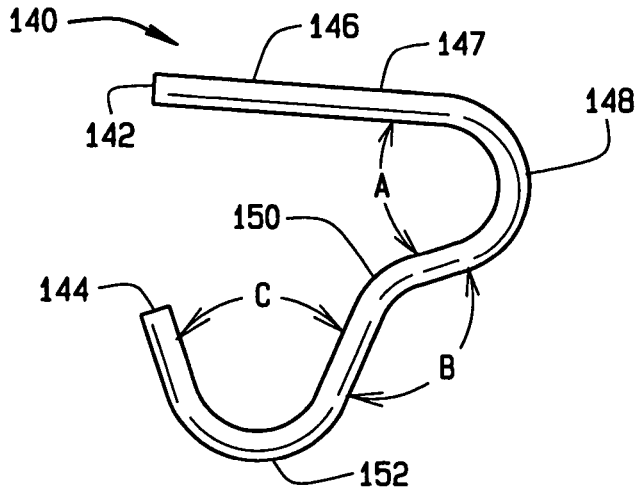
FIG. 11 is a side elevation view of an exemplary hook member shown in FIG. 8.
Figure 12:
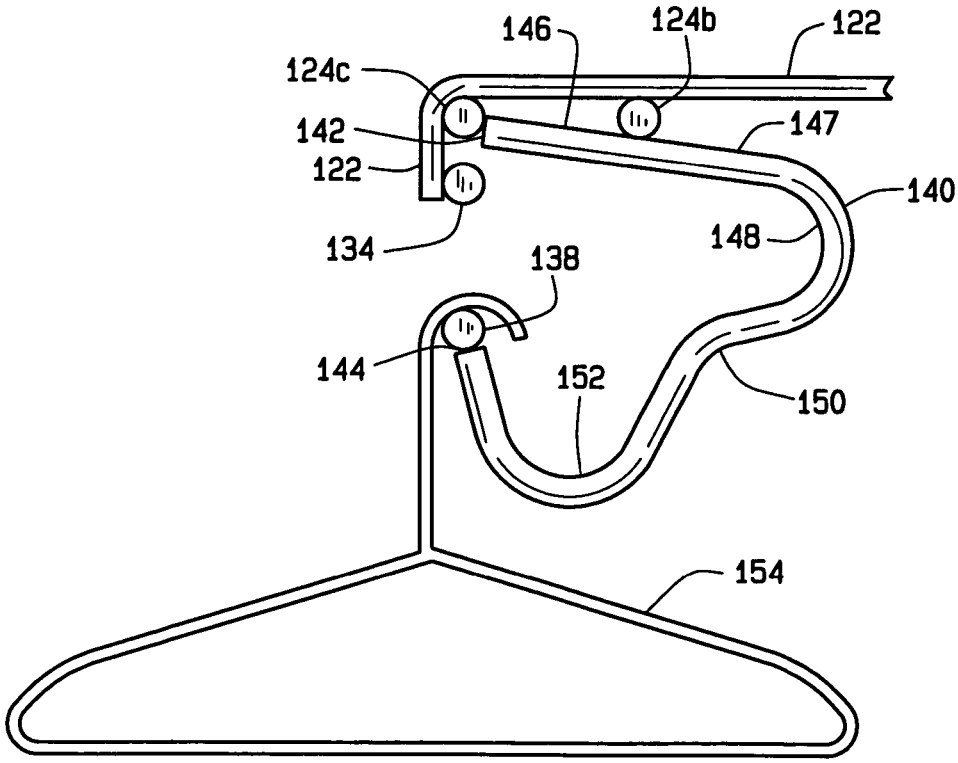
FIG. 12 is a side cross-sectional view of the shelf shown in FIG. 8 having a hanger supported thereon.

The rod member 138 is connected to the shelf deck 126 using the hook members 140. As shown in FIGS. 11 and 12, the hook member 140 includes a first end 142 and a second end 144. The first end 142 is connected to the front support member 124*c*, and the second end 144 is connected to the rod member 138. A wide range of suitable methods can be used to connect the first and second ends 142 and 144 to the respective front support member 124*c* and rod member 138, such as welding, adhesives, etc. In one embodiment, the first and second ends 142 and 144 are respectively welded to the front support member 124*c* and rod member 138.

With continued reference to FIG. 12, the hook member 140 has a generally horizontal upper portion 146. An upper surface 147 of the portion 146 is connected to the intermediate support member 124*b*. In one embodiment, the upper surface 147 is welded to the intermediate support member 124*b*, although other suitable fastening methods and means can be employed. In other embodiments, the upper surface of the portion 146 can also be connected (e.g., welded) to the front support member 124*a*instead of (or in addition to) connecting the end 142 to the front support member 124*c*.

Referring back to FIG. 11, the hook member 140 includes three curved portions 148, 150, and 152 that alternate in curvature extending from the horizontal portion 146 towards the second end 144. In one embodiment, the first and third curved portions 148 and 152 are generally configured in concave shape relative to the front end 132 of the shelf 120 and the second curved portion 150 is generally configured in a convex shape relative to the front end 132 of the shelf 120. The third curved portion 152 is configured to accommodate items, such as hangers 154, sliding along the rod member 138 as shown in FIG. 12.

For purposes of illustration only, various dimensions will now be provided for one exemplary embodiment of the hook member 140. Referring to FIG. 11, the length of the horizontal portion 146 is about 2.85 inches (72.5 millimeters), angle A is about twenty two degrees, angle B is about one hundred thirty two degrees, and angle C is about forty three degrees. Again, however, these dimensions are for purposes of illustration only and should not be construed as limiting the scope of the present invention.

Figure 13:
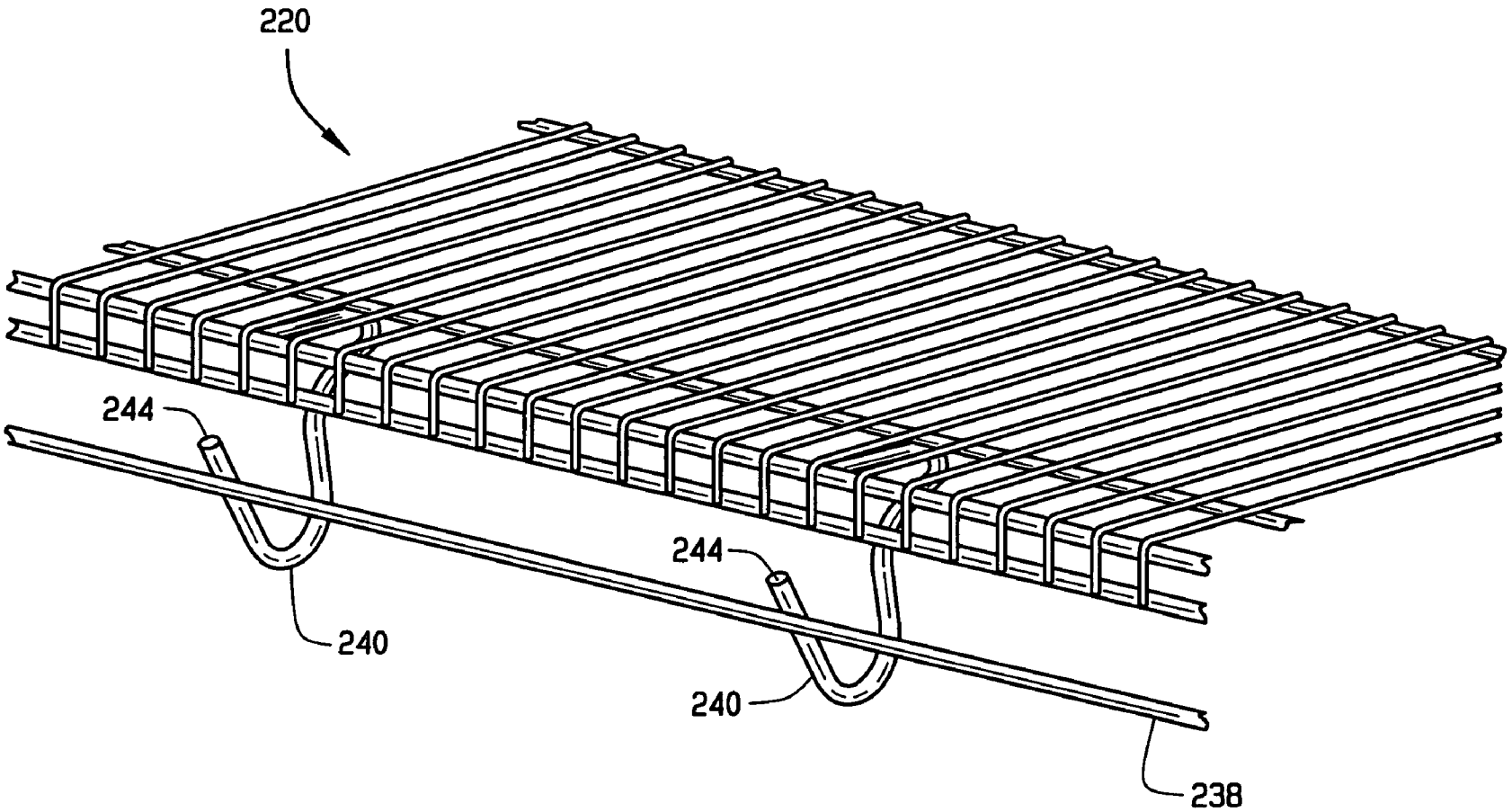
FIG. 13 is a top perspective view of a shelf having an integrated rod member connected thereto according to another exemplary embodiment of the invention.
Figure 14:
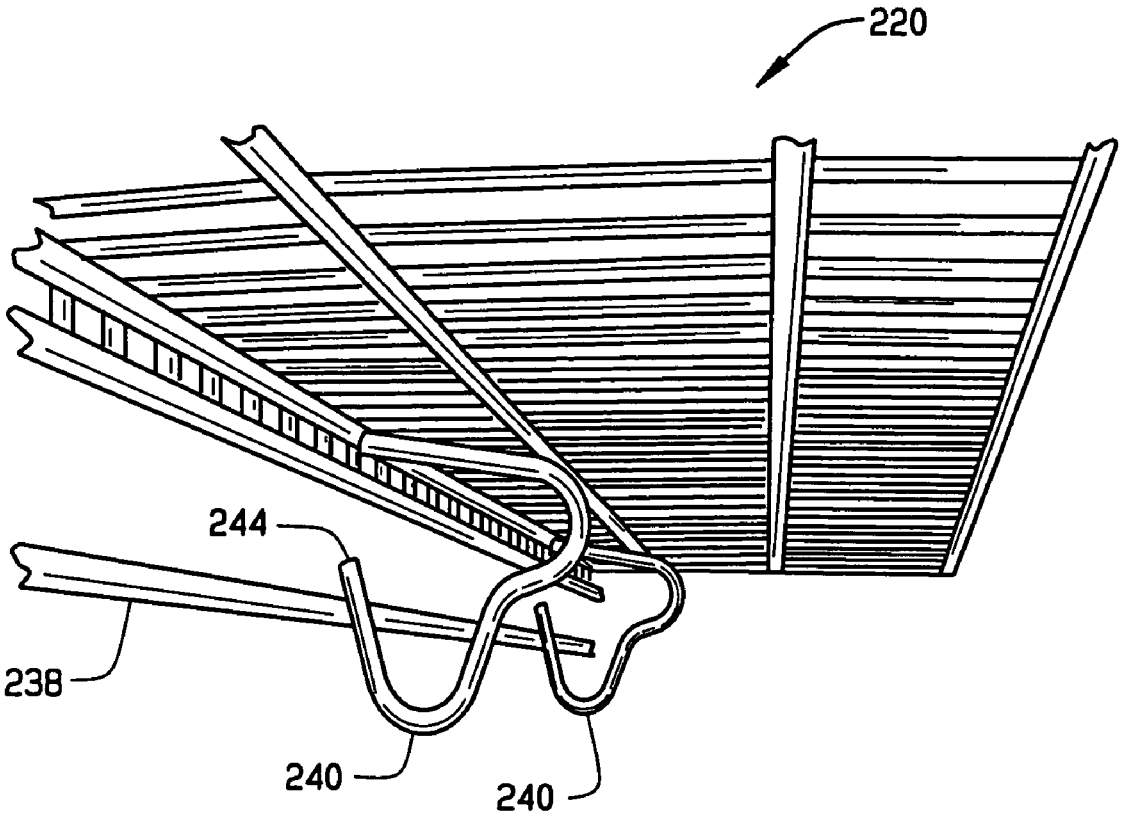
FIG. 14 is a bottom perspective view of the shelf shown in FIG. 13 including an additional longitudinally extending support member according to another exemplary embodiment of the invention.

FIGS. 13 and 14 illustrate another embodiment of a shelf 220 in which the second end 244 of the hook member 240 extends past the rod member 238. As shown, the rod member 238 is secured at another point besides the end 244 of the hook member 240.

It should be noted that the hook members 40, 140, and 240 of the present invention may be provided in connection with different shelf sizes, types and configurations and integrated therewith to provide a rod member 38, 138, 238 allowing for free sliding operation of items attached and connected (e.g., hanging) thereto.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A wire shelf comprising a plurality of wires, a plurality of support members, said plurality of wires and said plurality of support members forming a shelf deck, at least one hook member having a generally horizontal portion, the generally horizontal portion being connected to at least one of said support members and extending in a generally horizontal direction away from said at least one support member, the hook member including a rod support end portion and at least three curved portions alternating in curvature and extending from the generally horizontal portion towards the rod support end portion, and a rod member connected to the rod support end portion.

2. The wire shelf of claim 1, wherein the at least three curved portions comprise a first curved portion having a generally concave curvature relative to a front end of the wire shelf, a second curved portion having a generally convex curvature relative to the front end of the wire shelf, and a third curved portion having a generally concave curvature relative to the front end of the wire shelf, the second curved portion disposed between the first and third curved portions.

3. The wire shelf of claim 2, wherein the third curved portion is configured to allow hangers on the rod member to slide past the hook member without interference.

4. The wire shelf of claim 2, wherein the plurality of support members comprise forward and intermediate support members substantially contained in a generally horizontal plane, wherein the intermediate support member is disposed rearward of the forward support member, and wherein the first curved portion is disposed rearward of the intermediate support member.

5. The wire shelf of claim 1, wherein the plurality of support members comprise a front support member and an intermediate support member.

6. The wire shelf of claim 5, wherein a first end of the hook member is connected to the front support member, and wherein an upper surface of the generally horizontal portion is connected to the intermediate support member.

7. The wire shelf of claim 6, wherein the rod member is connected to the hook member such that a second end of the hook member extends beyond the rod member.

8. The wire shelf of claim 1, wherein the generally horizontal portion of the hook member is connected to at least two support members disposed in a common, substantially horizontal plane.

9. The wire shelf of claim 1, wherein the generally horizontal portion of the hook member is connected to at least one of said support members generally under said at least one support member.

10. The wire shelf of claim 1, wherein the generally horizontal portion of the hook member is connected to at least one support member by welding.

11. The wire shelf of claim 1, wherein the generally horizontal portion of the hook member is disposed under the shelf deck.

12. The wire shelf of claim 1, wherein the at least three curved portions comprise a first curved portion, a second curved portion, and a third curved portion, the first curved portion opening in a direction facing generally forward of the wire shelf and the third curved portion opening in a direction facing generally upward of the wire shelf, the second curved portion being disposed between the first and third curved portions.

13. The wire shelf of claim 1, wherein the curved portions define a region free of support members.

14. The wire shelf of claim 1, wherein the at least three curved portions comprise a first curved portion, a second curved portion, and a third curved portion, the first curved portion having a generally C-shape opening in a direction facing generally forward of the wire shelf and the third curved portion having a generally U-shape opening in a direction facing generally upward of the wire shelf, the second curved portion being disposed between the first and third curved portions.

15. The wire shelf of claim 1, wherein the plurality of support members comprise forward and intermediate support members substantially contained within a generally horizontal plane, wherein the intermediate support member is disposed rearward of the forward support member, and wherein the hook member's generally horizontal portion is connected to the forward and intermediate support members.

16. The wire shelf of claim 1, wherein the plurality of support members comprise forward and intermediate support members substantially contained within a generally horizontal plane, wherein the intermediate support member is disposed rearward of the forward support member, wherein a first end of the hook member is connected to the forward support member, wherein an upper surface of the generally horizontal portion is connected to the intermediate support member, and wherein the rod member is connected to the hook member such that a free end of the rod support end portion of the hook member extends beyond the rod member.

17. The wire shelf of claim 1, wherein the hook member includes a first free end opposite the rod support end portion, and wherein the generally horizontal portion of the hook member extends from the first free end to the first curved portion.

18. The wire shelf of claim 1, wherein the plurality of support members comprise a forward support member, a rearward support member, and an intermediate support member disposed between the forward and rearward support members, wherein the forward, rearward, and intermediate support members are substantially contained within a common plane, and wherein the hook member's generally horizontal portion is connected to at least the forward and intermediate support members.

19. The wire shelf of claim 18, wherein the generally horizontal portion of the hook member is only connected to the forward and intermediate support members.

20. A wire shelf comprising a plurality of wires, a plurality of support members, said plurality of wires and said plurality of support members forming a shelf deck, at least one hook member having a generally horizontal portion connected to at least two of the support members disposed in a common, substantially horizontal plane, the at least one hook member including a rod support end portion and at least three curved portions alternating in curvature and extending from the generally horizontal portion toward the rod support end portion, and a rod member connected to the rod support end portion.

21. A wire shelf comprising a plurality of wires, a plurality of support members, said plurality of wires and said plurality of support members forming a shelf deck, the support members including a forward support member, a rearward support member, and an intermediate support member disposed between the forward and rearward support members, the forward, rearward, and intermediate support members being substantially contained within a common plane, at least one hook member having a generally horizontal portion disposed under the shelf deck and welded to at least the forward and intermediate support members, the hook member including a rod support end portion and at least three curved portions alternating in curvature and extending from the generally horizontal portion towards the rod support end portion, and a rod member connected to the rod support end portion, the at least three curved portions including a first curved portion, a second curved portion, and a third curved portion, the first curved portion having a generally C-shape opening in a direction facing generally forward of the wire shelf and the third curved portion having a generally U-shape opening in a direction facing generally upward of the wire shelf, the second curved portion being disposed between the first and third curved portions.

22. A wire shelf comprising a plurality of wires, a plurality of support members, said plurality of wires and said plurality of support members forming a shelf deck, the support members including a forward support member and an intermediate support member disposed rearward of the forward support member, the forward and intermediate support members being substantially contained within a common plane, at least one hook member having a generally horizontal portion disposed under the shelf deck and connected to the forward and intermediate support members with an upper surface of the generally horizontal portion welded to a lower surface of the intermediate support member, the hook member including a rod support end portion and at least three curved portions alternating in curvature and extending from the generally horizontal portion towards the rod support end portion, and a rod member connected to the rod support end portion, the at least three curved portions including a first curved portion, a second curved portion, and a third curved portion, the first curved portion having a generally C-shape opening in a direction facing generally forward of the wire shelf and the third curved portion having a generally U-shape opening in a direction facing generally upward of the wire shelf, the second curved portion being disposed between the first and third curved portions.

* * * * *